United States Patent [19]

Fayen

[11] 4,454,866

[45] Jun. 19, 1984

[54] BATHROOM APPLIANCE FOR CONCURRENTLY SHARPENING RAZOR BLADES AND TREATING GUM TISSUE BY SPACED PRESSURE PULSES OF LIQUID

[76] Inventor: Carl F. Fayen, 1021 Westwood Dr., Durham, N.C. 27707

[21] Appl. No.: 302,558

[22] Filed: Sep. 16, 1981

[51] Int. Cl.[3] ..... A61H 9/00

[52] U.S. Cl. ..... 128/38; 128/66; 51/80 BS

[58] Field of Search ..... 128/66, 38; 30/38; 51/80 BS, 155; 76/81.7, 81.8

[56] References Cited

U.S. PATENT DOCUMENTS

| | | | |
|---|---|---|---|
| 959,496 | 5/1910 | Floyd | 51/80 BS |
| 1,044,036 | 11/1912 | Fassett . | |
| 1,085,526 | 1/1914 | Kanawah | 51/80 BS |
| 1,304,953 | 5/1919 | Floyd . | |
| 1,334,295 | 3/1920 | Floyd | 51/80 BS |
| 1,753,510 | 4/1930 | Gibson | 51/80 BS |
| 2,081,147 | 2/1929 | Holeman | 51/84 BS |
| 3,227,158 | 1/1966 | Mattingly | 128/66 |
| 3,254,406 | 6/1966 | Hubrich | 30/401 |
| 3,393,673 | 7/1968 | Mattingly | 128/66 |
| 3,405,710 | 10/1968 | Kovach | 128/66 |
| 3,425,410 | 2/1969 | Cammack | 128/66 |

*Primary Examiner*—Richard J. Apley
*Assistant Examiner*—David J. Brown
*Attorney, Agent, or Firm*—Fisher, Christen & Sabol

[57] ABSTRACT

A bathroom appliance for concurrently sharpening single or double edged razor blades and treating gum tissue by applying spaced pressure pulses of liquid to depress discrete areas of gum tissue with the spacing of said pulses one from the other of a duration which provides for rebound time for the gum tissue including a gum treating modular assembly and a razor blade sharpening modular assembly having a sharpening roller rotatably driven by the motor which drives the pump of the gum treating modular assembly and having a razor blade holder, the axis of which is parallel to the axis of the sharpening roller. The liquid holding means of the gum treating modular assembly includes a liquid level indicator designating the minimum amount of liquid needed in the reservoir to require operation of the pump and motor to the minimum extent necessary to drive the sharpening roller the number of rotations to impart and maintain a uniformly sharp edge on the razor blade.

9 Claims, 8 Drawing Figures

1
2
3
4
5
6
7
8
9
10
11
12
13
14
15
15
16
17
18
19
20

BATHROOM APPLIANCE FOR CONCURRENTLY SHARPENING RAZOR BLADES AND TREATING GUM TISSUE BY SPACED PRESSURE PULSES OF LIQUID

BACKGROUND OF THE INVENTION

1. Field of the Invention

This invention relates to the field of personal hygiene and grooming and more specifically relates to bathroom appliances utilized for treating the gums with a pulsating stream of liquid and to devices for sharpening razor blades for use in shaving.

2. The Prior Art

The use of a pulsating stream of a liquid, e.g. water, against the gums of the human mouth has been found to be extremely beneficial in not only cleaning the teeth and gums but also in improving the circulation of blood in the gum areas resulting in the enhancement of healthy gum tissue and teeth. Devices for providing beneficial pulsating streams of water are well known and are available in substantially all drug and department stores. U.S. Pat. Nos. 3,227,158, 3,393,673, 3,405,710 and 3,425,410 illustrate the various types of gum treating apparatus in which a pulsating stream of water is used to clean and massage the gums and teeth.

It has long been known to sharpen razor blades by stropping the edge of the blade along a mildly abrasive material notably leather until the steel of the blade edge has been honed to a fine and even sharpness. Razor stropping, however, is time consuming and requires a rhythmic motion of the hands which is difficult to achieve by many people. When razor blades became readily available at reasonable prices, razor stropping became unpopular and is hardly practiced at all except by barbers in barber shops.

Subsequently, manually operated stropping devices were developed so that the private individual could easily strop a safety razor blade by placing the blade into the device and cranking a handle until the blade achieved the desired sharpness. An illustration of such manual stropping device is described in U.S. Pat. Nos. 1,044,036 and 1,304,953. The manual stroppers, however, also consumed the user's personal time to operate and, for that reason, never achieved any substantial degree of popularity.

SUMMARY OF THE INVENTION

This invention relates to apparatus for concurrently treating gum tissue with a pulsating liquid stream and sharpening razor blades including a gum treating modular assembly and a razor blade sharpening modular assembly interconnected for driving by the same motor and readily separable. The gum treating modular assembly is of the well known type which comprises a liquid pump having an intake port, a discharge port and pump means for supplying time-spaced pulses of liquid to the discharge port and a motor for driving the pump means. The gum treating modular assembly also includes a reservoir for holding a supply of liquid, e.g. water, and means for supplying the liquid from the reservoir to the intake port.

The gum treating modular assembly includes mounting means for removably mounting said razor blade sharpening assembly and drive connecting means for connecting the drive output of the above-mentioned motor to the sharpening roller. Preferably provision is made on the gum treating modular assembly for receiving the razor blade sharpening modular assembly and holding same by gravity in driving connection with the motor of the gum treating modular assembly while permitting the easy detachment of the razor blade sharpening modular assembly from the gum treating modular assembly. In addition the gum treating modular assembly preferably includes a reducing gear train which drivably connects the motor of the gum treating modular assembly to the sharpening roller to reduce the rpm at which the roller is driven thereby permitting the sharpening rollers to rotate at a more effective rpm for sharpening the blade. It is also preferable to provide the reservoir of the gum treating modular assembly with a liquid level indicator designating the minimum amount of liquid needed in the reservoir which requires operation of the pump and motor to the minimum extent necessary for driving the sharpening roller of the blade sharpening modular assembly for the minimum number of rotations to maintain a uniformly sharp edge on the razor blade.

The razor blade sharpening modular assembly comprises at least one sharpening roller rotatably driven by the above mentioned motor and a blade holder having its axis parallel to the axis of the sharpening roller or rollers for holding the razor blade with its edge or edges against the sharpening roller or rollers in sharpening contact therewith.

In a specific type of razor blade sharpening modular assembly, the assembly comprises a pair of parallel sharpening rollers arranged side-by-side with their axes parallel to each other and geared to rotate together in opposite directions. The blade holder is adapted to hold a double edge razor blade to dispose one side of one edge in sharpening contact with one roller and of the other edge in sharpening contact with the other roller or in the case of a single edge razor blade, the blade holder is adapted to dispose one side of the single edge in sharpening contact with one roller. There is also included a means for rotating the blade holder 180° to dispose the other side of said edges into sharpening contact with the respective sharpening rollers. Each roller is fixed to a gear which drivably meshes with the gear of the other roller and one roller is keyed to a drive shaft which is adapted to be connected, preferably through a series of reduction gears, to the motor of the above-mentioned gum treating modular assembly. Each of the rollers is formed with a flattened portion extending from end to end to allow clearance for rotation of the blade and one of the rollers is provided with a gear segment and a cam portion. The blade holder is fitted with a cam portion which cooperates with the cam portion on the above-mentioned roller to prevent rotation of the holder during all but the last few degrees of rotation of the roller. The gear segment of the holder cooperates with a corresponding gear segment on the cam portion of the roller to rotate the blade holder 180° for each 360° rotation of the rollers. The respective gear segments are so registered that the flattened portion of the rollers generally faces the blade holder at the time that the gear segments contact each other to rotate the blade holder.

The present invention provides the unique function of permitting the sharpening of a razor blade to substantially the same degree each time the blade is sharpened and provides for the concurrent sharpening of razor blades and treatment of gum tissue. The present invention results in the conservation of energy in that a single razor blade can be used over and over again. For example, a single stainless steel razor blade has been used for over 5,500 shaves and has still maintained unsurpassed sharpness and smoothness. In normal use heretofore, prime surgical steel blades have been thrown away after five to seven days use. In addition, the present invention permits the honing of a razor blade prior to the first shave to eliminate unevenness in the new blade's cutting edge or edges and is useful thereafter to maintain sharpness and evenness of the edge or edges to provide smooth and comfortable shaves and to avoid nicking of the shaver's skin. The present invention permits one to utilize the pulsating stream of water to clean his or her teeth and to treat his or her gums while honing a razor blade to an even and smooth sharpness. It also permits the combination of these two important functions into a compact unit while still permitting the razor blade sharpening module to be readily detached from the gum treating module for the purpose of simplifying the removal of the razor blade from the sharpening module and permits easy removal of the sharpening module for the purposes of manually operating the sharpening module if such is desired. This enables removal of the sharpening module and use at locations where electricity is not readily accessable or in those instances where the complete unit including the gum treating module is not desired to be transported, for example, on camping trips.

An especially unique feature of the invention is the provision of an indicator in the reservoir which designates the minimum amount of water which must be pumped out by the gum treating module in order to empty the reservoir, which minimum amount of water corresponds to the number of rotations of the sharpening roller or rollers of the sharpening module necessary for providing the minimum level of sharpness and uniformity to the cutting edge or edges of the blade. The compactness of the apparatus of this invention is a desirable feature to avoid and reduce clutter in the bathroom. Thus, the water in the reservoir serves the dual functions of cleaning the teeth and treating the gums as well as providing a signal or indication of the minimum number of revolutions of the sharpening rollers. If desired, the indicator in the reservoir can be placed at a level which by experience has provided the optimum degree of sharpening of the blade. I have found that in general 60–100, preferably 70–90, revolutions of each sharpening roller is necessary in order to provide optimum results of sharpness and uniformity of the cutting edge or edges of the blade. In addition, the present invention avoids oversharpening of the blade which decreases the blade life and also decreases the life of the sharpening surface such as leather. Normally in the operation of the device of the present invention a full or nearly full reservoir may be desired to be used in cleaning the teeth and treating the gums in which case the blade can be inserted into the blade holder which is then inserted into the sharpening module prior to beginning the cleaning and treating operation thus placing the sharpening module in condition for placement on the gum treating module for driving of the sharpening module. Thus, the teeth cleaning and gum treating operation can be carried out until the water level reaches the indicator at which point the sharpening module is simply placed on the gum treating module by which it is drivably connected thereto and the teeth cleaning and gum treating operations can be continued while concurrently operating the sharpening module to sharpen the razor blade to a uniform and fine sharpness. At the time that the water in the reservoir is depleted, the pump means of the gum treating module makes a notably different sound thus providing an audible signal that the honing of the razor blade to the selected extent has been completed.

Another advantageous feature of the present invention is the provision of a drive shaft extending from one of the rollers of the sharpening module, which shaft is adapted to enter and drivably connect with a drive socket in the gum treating module and is adapted to be held in drivable connection with the socket by the weight of the sharpening module. Thus, the sharpening module can be simply placed on and easily lifted off of the gum treating module. As a part of the present invention, the power drive train for driving the sharpening module is substantially totally included within the gum treating module.

DESCRIPTION OF A SPECIFIC EMBODIMENT

Figure 1:
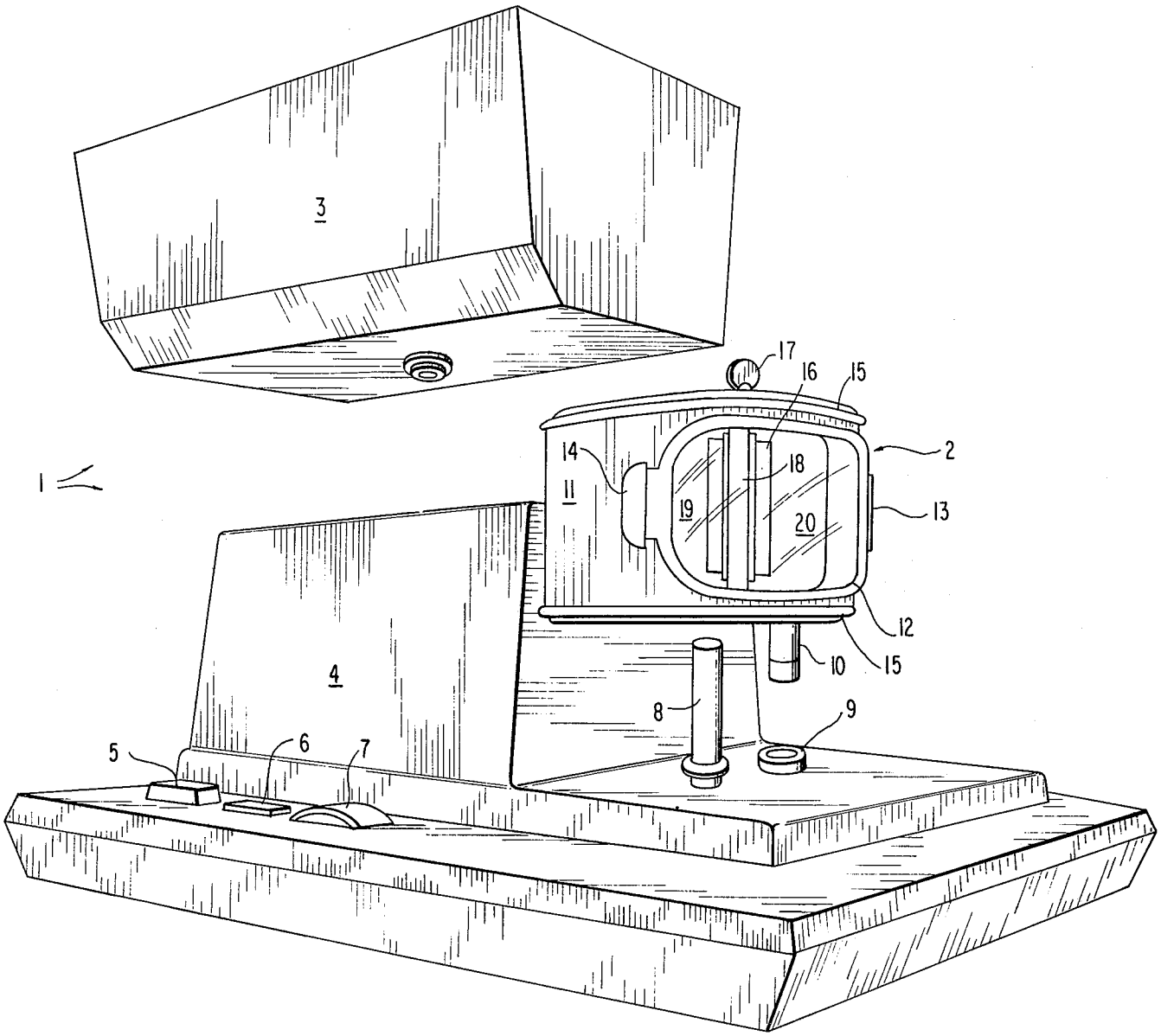
FIG. 1 is an isometric view illustrating the gum treating module with its reservoir suspended above the remainder of the assembly and illustrates the sharpening module suspended above the drive connection in the gum treating assembly.

Referring to FIG. 1, the bathroom appliance of this invention is shown isometrically and includes a gum treating module 1 and a razor blade sharpening module 2. The gum treating module comprises a water reservoir 3 here shown suspended above the remainder of the gum treating module 1 and a housing 4 containing the remaining components of the gum treating module 1, which remaining components are more specifically described in connection with FIGS. 5–8. As shown in FIG. 1, there is provided in the housing an on-switch 5, an off-switch 6 and a regulating knob 7 for regulating the frequency pressure of the pulses. The housing 4 is also provided with an alignment post 8 adapted to receive the blade sharpening module 2 by passing into the core of one of the rollers which is more specifically explained hereinafter. The housing 4 also is provided with a drive socket 9 in which a slotted drive shaft described more fully hereinafter is rotatably mounted for receiving a bladed drive shaft 10 which is keyed to the other roller of the blade sharpening module 2 for the purposes of driving said roller. The blade sharpening module 2 also contains a cover 11 extending around the module, an access window 12 hinged to the cover 11, by hinges 13 at one side of the window and is held closed by a clasp arrangement 14 at the other side of the window. End walls 15 complete the enclosure of the blade sharpening module 2. The interior components are described hereinafter.

Figure 4:
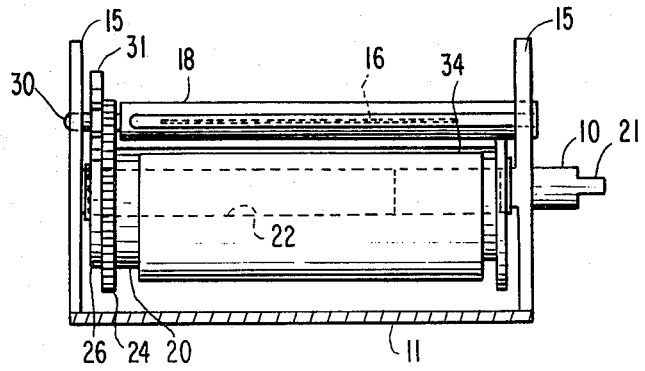
FIG. 4 is a side elevation of the sharpening module in which the cover has been removed to illustrate the internal parts.
Figure 5:
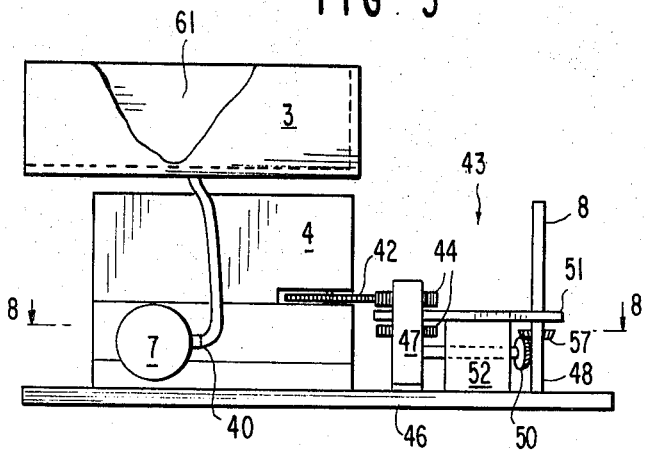
FIG. 5 is a front elevation of the gum treating module showing a cutaway of part of the wall of the reservoir to illustrate the water level indicator.
Figure 7:
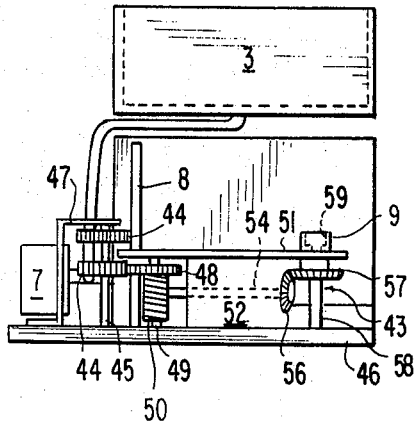
FIG. 7 is a side elevation of the gum treating module shown in FIGS. 5 and 6.
Figure 6:
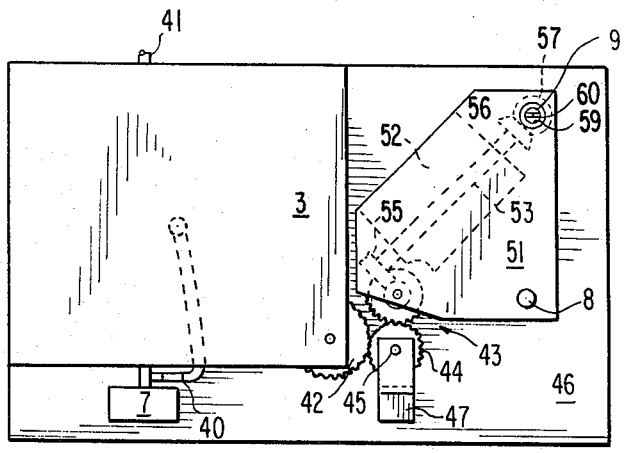
FIG. 6 is a plan view of the gum treating module and, with FIG. 5, illustrates the reducing gear train connecting a sharpening roller of the sharpening module with the motor of the gum treating module.
Figure 8:
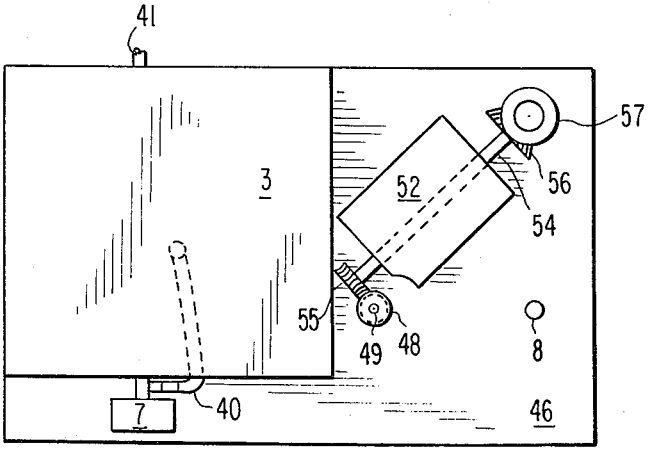
FIG. 8 is a plan view similar to FIG. 6 with an internal top plate removed to more clearly illustrate the gearing and also the bearing block internally used in the reducing gear train.

FIG. 1 also illustrates the positioning of a razor blade 16 of the two edge type in a hinged blade clamp 17 similar to that shown in FIGS. 4 and 5 of U.S. Pat. No. 1,044,036 which is adapted to slide into the blade holder 18 which is journaled into the end walls 15. Sharpening rollers 19 and 20 having a leather stropping surface are also shown in FIG. 1 in contact with one side of each edge of the blade.

Figure 2:
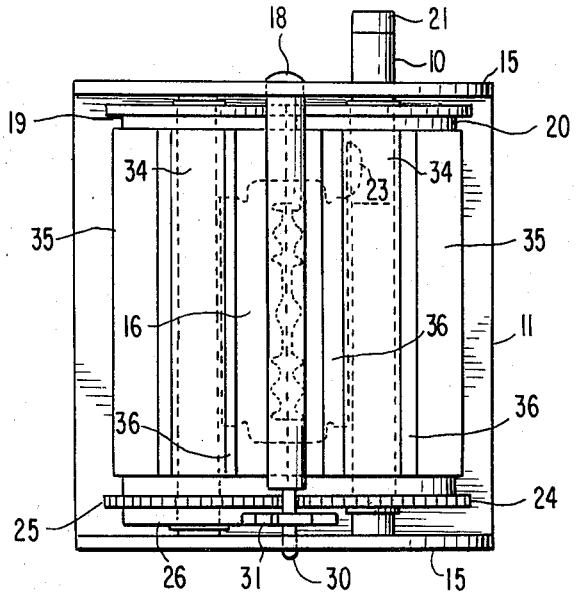
FIG. 2 is a plan view of the sharpening module in which its cover has been removed and in which the sharpening rollers are disposed in a horizontal plane.
Figure 3:
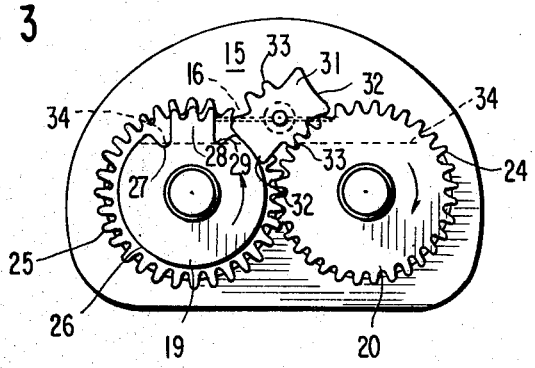
FIG. 3 is an end view of the sharpening module in which the side cover has been removed to enable showing the gearing of the two rollers as well as the cam sections for the blade holder and one of the rollers.

FIGS. 2–4 illustrate the internal mechanism of the blade sharpening modular assembly 2 which includes the rollers 19 and 20 which are journaled to the side walls 15. Roller 20 is provided with a bladed drive shaft 10 having a blade portion 21 that fits into slotted drive socket 9 more fully described hereinafter. The bladed drive shaft 10 passes into the core 22 of roller 20 and is keyed, for example, by means of key 23 to the inner wall of the core such that turning of the drive shaft 10 also turns roller 20. On the opposite end roller 20 is provided with a gear 24 which meshes with an identical type of gear 25 mounted on the end of roller 19. On the outboard side of gear 25 there is mounted a cam surface 26 which is circular for most of its circumference but is formed with a first dip portion 27, a gear portion 28 and a second dip portion 29 in that sequence.

Blade holder 18 is formed with a pin 30 at one end which is journaled in one side wall 15 adjacent the gears 24, 25, and cam surface 26. Inboard from the pin 30 the blade holder 18 is provided with a cam section 31. A cam section 31 is formed with two opposing concave circular surfaces 32 which alternately cooperate with the circular portion of cam surface 26 to prevent rotation of the cam holder 18 until first dip portion 27 reaches the cam section. First dip portion 27 causes the cam section 31 to rotate in a clockwise direction as viewed in FIG. 3. The cam section 31 is also formed with gear teeth 33 on opposite sides between the concave cam portions 32. As the cam section 31 is rotated the gear teeth 33 on one side of cam section 31 are engaged by the gear portion 28 of cam surface 26 resulting in the continuation of rotation of cam section 31 until 180° rotation is achieved. At this point the other concave cam portion 32 on cam section 31 mates with the circular portion of cam surface 26 and the blade holder is thus held stationary for almost another complete rotation of roller 19.

The opposite end of blade holder adjacent the bladed drive shaft 10 is journaled in end wall 15. A slot also is provided in said end wall to permit insertion of the razor blade held in blade clamp 17 through said end wall 15. The blade clamp 17 is not shown in FIGS. 2–4; however, the position of double edged razor blade 16 is shown in phantom in FIG. 2.

Each roller 19 and 20 is formed with a flattened portion 34 both of which are so positioned that when the blade holder 18 is being rotated through its half rotation the flattened portions provide clearance for passage of the blade edges past the rollers 19 and 20. Each roller 19 and 20 is provided with a leather stropping surface 35 which is held to the respective roller by means of the clamping action of metal pieces 36 running along the flattened portion 34 of each roller.

Referring to FIGS. 5–8 there is shown a gum treating module of a conventional type having a water reservoir 3 and a housing 4 containing a liquid pump having an intake port 40 and a discharge port 41 which is connected by a tubing to a handpiece for directing a pulsating stream of water into the mouth of the user. A gum treating modular assembly includes within the housing 4 pump means for supplying time-spaced pressure pulses of liquid from the reservoir 3 to the discharge port 41 and thence to the handpiece. Also included in housing 4 is a motor for operating the pump. The interior portions of housing 4 are not shown in detail inasmuch as such parts are conventional and such units are available in substantially every drug store and department store in the United States.

Such a conventional unit also includes a gear 42 driven by the motor within the housing at a given rpm such as 660 rpm. This rate of rotation is somewhat higher than is desired for the rotational speed of bladed drive shaft 10 for the blade sharpening modular assembly. Therefore the conventional unit is shown in FIGS. 5–8 as being slightly modified to include a reducing gear train 43 designed in the instance shown to reduce the rotational speed from 660 rpm, for example, down to about 80 rpm. As shown the gear train includes two spur gears 44 mounted on the same shaft 45 which is journaled at its lower end to the base 46 of the gum treating module. A bracket 47 is also mounted on base 46 and the upper end of spur gear shaft 45 is journaled in the upper end of bracket 47. Lower spur gear 44 mounted on vertical spur gear shaft 45 meshes with a third spur gear 48 mounted on worm gear shaft 49 which also mounts worm gear 50. The worm gear shaft 49 is journaled at its lower end in the base 46 and is journaled at its upper end in platform 51 which is mounted in a position spaced above base 46. The platform 51 is supported by bearing block 52 and alignment post 8, both of which are mounted on base 46. The bearing block is formed with a bore 53 through which bevel gear shaft 54 passes. A worm wheel 55 is mounted on one end of bevel gear shaft 53 and engages and cooperates with worm gear 50 so that rotation of worm gear shaft 49 causes rotation of bevel gear shaft 54. At the other end of bevel gear shaft 54 is mounted a bevel gear 56 which engages and cooperates with a second bevel gear 57 which is mounted on slotted drive socket shaft 58. The lower end of slotted drive socket shaft 58 is journaled in the base 56 and the upper end is fitted with a slotted drive socket 9 which is journaled in platform 51. Socket 9 is formed with an internal bore 59 in its upper end at the bottom of which there is formed a slot 60 into which the blade 21 of the bladed drive shaft 10 of the blade sharpening module fits to drivably connect the socket 9 and the bladed drive shaft 10. Thus, in operation the gear 42 of the conventional gum treating module can contain, for example, 48 teeth and can be rotating at 660 rpm. Spur gear 44, for example, can have 28 teeth and would be rotated at a speed of about 1178 rpm. Third spur gear 48 and worm gear 50 thus are also rotated at about 1178 rpm. The worm gear set as an example is 15 to 1 which results in a rotation of worm wheel 55 and bevel gear shaft 54 at a speed of approximately 80 rpm. The tooth ratio between bevel gears 56 and 57 as an example is 1 to 1 thus providing a rotation speed of about 80 rpm to the slotted drive socket shaft 58 and to the drive socket 9. Suitable rotational speeds for the slotted drive socket 9 and the bladed drive shaft 10 of the blade sharpening module can range from about 50 to about 100 rpm, preferably about 60–90 rpm. Faster rates of rotation are possible but usually not desirable because of the increased noise and the increased risk of damaging the blade or the sharpening unit. Lower speeds are also possible although slower speeds can unduly prolong the sharpening time.

Alignment post 8 is so proportioned as to easily slide into the core of roller 19 and is spaced a sufficient distance from drive socket 9 that as the core of roller 19 is slipped on alignment post 8, the bladed shaft 10 easily slips into drive socket 9. In the case where the slot 60 of drive socket 9 is not aligned with the blade 21 of bladed drive shaft 10, the first half revolution of the slotted drive shaft 58 will bring about such alignment thus permitting the blade 21 to drop by gravity into the slot 60 and establish a driving connection to the rollers 19 and 20. The sharpening module is held by gravity in the operative position and requires no further attention until the desired extent of blade sharpening has been achieved. At such time the sharpening module is simply lifted to disengage the drive blade 21 from the slot 60. The razor blade 16 is removed by pulling the blade clamp 18 and the razor blade 16 out through the slot provided in end wall 15.

FIG. 5 illustrates the level indicator 61 in reservoir 3 which corresponds to an amount of water in the reservoir, the pumping out of which will concurrently provide the number of revolutions of sharpening rollers 19 and 20 required to provide the requisite sharpness to the edges of the double edge blade 16. A total of 80 revolutions of rollers 19 and 20 has been determined by long term testing to be optimum although between about 60 to about 100, preferably about 70 to about 90, revolutions provides good sharpening results.

A hand crank (not shown) can be provided to drivably mate with bladed drive shaft 10 so that the sharpening module can be used in those cases where electricity is not available, e.g., on camping trips or during power outages. Further, adaptations are obvious to the apparatus described above to permit the sharpening of at least the exposed side of the latest type of blade in which one or two thin strips of razor are embedded in a plastic head as exemplified by the TRAC II system. The present invention is not limited to the precise embodiment or embodiments described hereinabove. Various changes and modifications may be effected to the invention as described without departing from the scope of the present invention as defined in the appended claims.

What is claimed is:

1. Apparatus for sharpening single or double edged razor blades and for concurrently treating gum tissue by applying spaced pressure pulses of liquid to depress discrete areas of gum tissue with the spacing of said pulses one from the other of duration which provides for rebound time for said gum tissue comprising a gum-treating modular assembly comprising:

(a) a liquid pump having an intake port, a discharge port and means for supplying time-spaced pressure pulses of liquid to said discharge port;

(b) a reservoir for holding a supply of said liquid, said reservoir being provided with a liquid level indicator designating the minimum amount of liquid needed in said reservoir to require operation of said pump and motor to the minimum extent necessary to drive said sharpening roller the number of rotations required to maintain a uniformly sharp edge on said razor blade;

(c) means for supplying liquid from said reservoir to said intake port; and (d) a motor for driving said pump means; and a razor blade sharpening modular assembly comprising (e) a sharpening roller rotatably driven by said motor; and (f) a blade holder having its axis parallel to the axis of said roller for holding said razor blade with its edge against said sharpening roller in sharpening contact therewith.

2. Apparatus as claimed in claim 1 wherein said gum-treating modular assembly also includes (g) mounting means for removably mounting said razor blade sharpening assembly, and (h) drive connecting means for connecting the drive output of said motor to said sharpening roller.

3. Apparatus as claimed in claim 1 wherein said razor blade sharpening modular assembly comprises (e) a pair of parallel sharpening rollers forming a nip and geared to rotate together in opposite directions and said blade holder is adapted to hold a double edge razor blade to dispose one side of one edge in sharpening contact with one roller and of the other edge in sharpening contact with the other roller.

4. Apparatus as claimed in claim 3 wherein said razor blade sharpening modular assembly comprises (i) means for rotating said blade holder 180° to dispose the other side of said edges into sharpening contact with the respective sharpening rollers.

5. Apparatus as claimed in claim 4 wherein each said roller is fixed to a gear which meshes with the gear of the other roller and wherein one said roller is keyed to a drive shaft adapted to be connected through reduction gears to said motor.

6. Apparatus as claimed in claim 5 wherein each said roller is formed with a flattened portion extending from end to end to allow clearance for rotation of said blade.

7. Apparatus as claimed in claim 6 wherein said blade holder is fitted with a cam portion which cooperates with a cam portion at the end of one said roller to prevent rotation of said holder and a gear segment which cooperates with a gear segment on said cam portion of said roller to rotate said blade holder 180° for each 360° rotation of said rollers.

8. Apparatus as claimed in claim 1 wherein a gear train drivably connects said motor to said sharpening roller to reduce the rpm at which said roller is driven.

9. Apparatus as claimed in claim 1 wherein said sharpening roller is keyed to a drive shaft and said mounting means for said sharpening assembly comprises a vertical mounting post for passing into a core in said sharpening assembly, said core being substantially parallel to said sharpening roller, and a drive socket drivably connected to said motor and adapted to receive said drive shaft keyed to said sharpening roller.

* * * * *